US008584772B2

(12) United States Patent
Yang et al.

(10) Patent No.: US 8,584,772 B2
(45) Date of Patent: Nov. 19, 2013

(54) SHAPED CHARGES FOR CREATING ENHANCED PERFORATION TUNNEL IN A WELL FORMATION

(75) Inventors: Wenbo Yang, Sugar Land, TX (US); Lawrence A. Behrmann, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1260 days.

(21) Appl. No.: 11/307,756

(22) Filed: Feb. 21, 2006

(65) Prior Publication Data

US 2006/0266551 A1 Nov. 30, 2006

Related U.S. Application Data

(60) Provisional application No. 60/594,997, filed on May 25, 2005.

(51) Int. Cl.
*E21B 43/116* (2006.01)
*E21B 43/117* (2006.01)

(52) U.S. Cl.
CPC ..... *E21B 43/117* (2013.01)
USPC ..... 175/4.6; 166/55.1

(58) Field of Classification Search
USPC ..... 166/55.1; 175/4.6; 102/476, 306–307
See application file for complete search history.

(56) References Cited

U.S. PATENT DOCUMENTS 3,054,938 A * 9/1962 Meddick ..... 102/310
3,235,005 A 2/1966 Delacour
3,255,659 A * 6/1966 Venghiattis ..... 86/20.14
4,160,412 A * 7/1979 Snyer et al. ..... 102/307
4,253,523 A * 3/1981 Ibsen ..... 166/299
4,766,813 A * 8/1988 Winter et al. ..... 102/307
5,098,487 A * 3/1992 Brauer et al. ..... 148/432
5,259,317 A * 11/1993 Lips ..... 102/307
5,331,895 A * 7/1994 Bourne et al. ..... 102/307
5,567,906 A * 10/1996 Reese et al. ..... 102/307
5,859,383 A * 1/1999 Davison et al. ..... 102/307
6,152,040 A 11/2000 Riley
6,446,558 B1 * 9/2002 Peker et al. ..... 102/306
6,655,291 B2 * 12/2003 Pratt et al. ..... 102/307
6,962,634 B2 11/2005 Nielson et al.
7,165,614 B1 * 1/2007 Bond ..... 166/297
7,278,353 B2 * 10/2007 Langan et al. ..... 102/306
7,278,354 B1 * 10/2007 Langan et al. ..... 102/306

(Continued)

FOREIGN PATENT DOCUMENTS

WO WO 95/35477 12/1995
WO 2005/035939 A1 4/2005

*Primary Examiner* — Cathleen Hutchins
(74) *Attorney, Agent, or Firm* — Jeffrey R. Peterson; Brandon Clark

(57) ABSTRACT

A shaped charge includes a charge case; an explosive disposed inside the charge case; and a liner for retaining the explosive in the charge case, wherein the liner comprises a material reactive with a component of an earth formation. A method for perforating in a well includes disposing a perforating gun in the well, wherein the perforating gun comprises a shaped charge having a charge case, an explosive disposed inside the charge case, and a liner for retaining the explosive in the charge case, wherein the liner includes a material that can react with a component of an earth formation; detonating the shaped charge to form a perforation tunnel in a formation zone; and allowing the material comprising the liner to react with the component of the earth formation.

15 Claims, 6 Drawing Sheets

(56) References Cited

U.S. PATENT DOCUMENTS

| | | | | |
|---|---|---|---|---|
| 2002/0007754 | A1* | 1/2002 | Reese et al. | 102/476 |
| 2002/0189482 | A1* | 12/2002 | Kneisl et al. | 102/306 |
| 2003/0037692 | A1* | 2/2003 | Liu | 102/301 |
| 2003/0037693 | A1* | 2/2003 | Wendt et al. | 102/306 |
| 2003/0131749 | A1* | 7/2003 | Lussier | 102/306 |
| 2004/0020397 | A1* | 2/2004 | Nielson et al. | 102/476 |
| 2004/0200377 | A1* | 10/2004 | Collins et al. | 102/476 |
| 2004/0255812 | A1* | 12/2004 | Bourne et al. | 102/476 |
| 2005/0011395 | A1* | 1/2005 | Langan et al. | 102/476 |
| 2005/0056459 | A1* | 3/2005 | Haney et al. | 175/4.6 |
| 2005/0115448 | A1* | 6/2005 | Pratt et al. | 102/476 |
| 2005/0241522 | A1* | 11/2005 | Stawovy | 102/476 |
| 2007/0056462 | A1* | 3/2007 | Bates et al. | 102/476 |

* cited by examiner

SHAPED CHARGES FOR CREATING ENHANCED PERFORATION TUNNEL IN A WELL FORMATION

CROSS-REFERENCE TO RELATED APPLICATIONS

The present application claims priority of U.S. Provisional Patent Application Ser. No. 60/594,997 filed on May 25, 2005. This Provisional Application is incorporated by reference in its entirety.

BACKGROUND OF INVENTION

1. Field of the Invention

The present invention relates generally to perforating tools used in downhole applications, and more particularly to shaped charges for creating an enhanced perforation tunnel in a target formation zone in a well.

2. Background Art

To complete a well, one or more formation zones adjacent a wellbore are perforated to allow fluid from the formation zones to flow into the well for production to the surface or to allow injection fluids to be applied into the formation zones. A perforating gun string may be lowered into the well and one or more guns fired to create openings in casing and to extend perforations into the surrounding formation.

With reference to FIG. 1, after a well 11 is drilled, a casing 12 is typically run in the well 11 and cemented to the well 11 in order to maintain well integrity. After the casing 12 has been cemented in the well 11, one or more sections of the casing 12 that are adjacent to the formation zones of interest (e.g., target well zone 13) may be perforated to allow fluid from the formation zones to flow into the well for production to the surface or to allow injection fluids to be applied into the formation zones.

To perforate a casing section, a perforating gun string may be lowered into the well 11 to a desired depth (e.g., at target zone 13), and one or more perforation guns 15 are fired to create openings in the casing and to extend perforations into the surrounding formation 16. Production fluids in the perforated formation can then flow through the perforations and the casing openings into the wellbore.

Typically, perforating guns 15 (which include gun carriers and shaped charges mounted on or in the gun carriers or alternatively include sealed capsule charges) are lowered through tubing or other pipes to the desired well interval on a line 17 (e.g., wireline, e-line, slickline, coiled tubing, and so forth). The charges carried in a perforating gun may be phased to fire in multiple directions around the circumference of the wellbore. Alternatively, the charges may be aligned in a straight line. When fired, the charges create perforating jets that form holes in surrounding casing as well as extend perforations into the surrounding formation.

Various types of perforating guns exist. One type of perforating guns includes capsule charges that are mounted on a strip in various patterns. The capsule charges are protected from the harsh wellbore environment by individual containers or capsules. Another type of perforating guns includes non-capsule shaped charges, which are loaded into a sealed carrier for protection. Such perforating guns are sometimes referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. In a hollow-carrier gun, charges shoot through the carrier into the surrounding casing formation.

There have been attempts to optimize the design of shaped charges for producing deeper penetrations into the formation. For example, U.S. Pat. No. 6,152,040 issued to Riley et al. discloses a shaped charge having a liner formed from a metal having a fine, uniform grain structure. The finer grains make it possible to produce less variation in the liner material structure, leading to more symmetric projectile jets to produce deeper perforation tunnels.

U.S. Pat. No. 6,446,558 issued to Peker et al. discloses shaped charges having a liner made of a composite material of fibers or particles of a solid reinforcement dispersed in a solid amorphous matrix. The penetrator jet (projectile) formed from such a liner may operate by two mechanisms: semi-liquid mass and solid mass penetrators, leading to deeper perforation tunnels.

While producing deeper perforation tunnels is desirable, it is equally important that the resultant tunnels are permeable so that the formation fluids can flow into the well. One problem often encountered in perforation operations is that the slug from a molten liner of a shaped charge may be embed in the perforated hole (tunnel), impeding the flow of oil into the well casing. Thus, attempts have been made to improve the design of a liner of a shaped charge such that the damage caused by the liner can be minimized.

A typical liner is prepared from pure metals, alloys, and/or ceramics. U.S. Pat. No. 5,098,487 issued to Brauer et al. discloses copper alloy-based metal liner for shaped charges. Such a liner has a ductile metal matrix and a discrete second phase. The second phase is molten when the liner is accelerated following detonation. The molten phase reduces the tensile strength of the matrix so that the liner slug is pulverized on striking a well casing. The slug does not penetrate the hole perforated in the well casing by the liner jet. As a result, oil flow into the well bore is not impeded.

Published U.S. patent application Ser. No. 2005/0011395 discloses thermal spray techniques for making a liner comprising two reactive components. According to these techniques, reactive components are thermally sprayed together and/or sequentially to build up a "green body" comprising the reactive components. Although a portion of the reactive components may react with each other during the thermal spraying operation, at least a portion of the reactive components remain unreacted in the green body. The reactive components may subsequently be reacted by any suitable initiation techniques, such as from the heat or shock of an explosion.

Published U.S. patent application Ser. No. 2005/0056459 discloses shaped charges having a pressed polymer (e.g., fluorinated polymer) pellet positioned between the explosive charge and the metal liner. The polymer will ignite and burn after being injected into a perforated tunnel. The burning of the polymer helps to stimulate (fracture) the well.

Published U.S. patent application Ser. No. 2005/0115448 discloses shaped charges having liners designed for sandy formation. The liner is low density and has a filler material that is enclosed by a polymer resin skin, such as plastic or polyester. The filler material is in the powdered or granulated form and is left largely unconsolidated. The powdered or granulated materials is a metal powder that is coated with a polymer, thereby permitting a secondary reaction inside the formation following detonation.

While these prior art approaches can produce improved perforation tunnels, there is still a need for improved liners that can produce perforation tunnels with no or minimal damage caused by the liner.

SUMMARY OF INVENTION

In one aspect, embodiments disclosed herein relate to shaped charges. A shaped charge in accordance with one embodiment of the invention includes a charge case; an explosive disposed inside the charge case; and a liner for retaining the explosive in the charge case, wherein the liner comprises a material reactive with a component of an earth formation.

In another aspect, embodiments of the invention relate to methods for perforating in a well. A method for perforating in a well in accordance with one embodiment of the invention includes disposing a perforating gun in the well, wherein the perforating gun comprises a shaped charge having a charge case, an explosive disposed inside the charge case, and a liner for retaining the explosive in the charge case, wherein the liner includes a material that can react with a component of an earth formation; detonating the shaped charge to form a perforation tunnel in a formation zone; and allowing the material comprising the liner to react with the component of the earth formation.

Other aspects and advantages of the invention will become apparent from the following description and the attached claims.

DETAILED DESCRIPTION

Embodiments of the invention relate to shaped charges and methods used in perforating a well, cased or not cased. In the following description, numerous details are set forth to provide an understanding of the present invention. However, it will be understood by those skilled in the art that the present invention may be practiced without these details and that numerous variations or modifications from the described embodiments may be possible.

Figure 1:
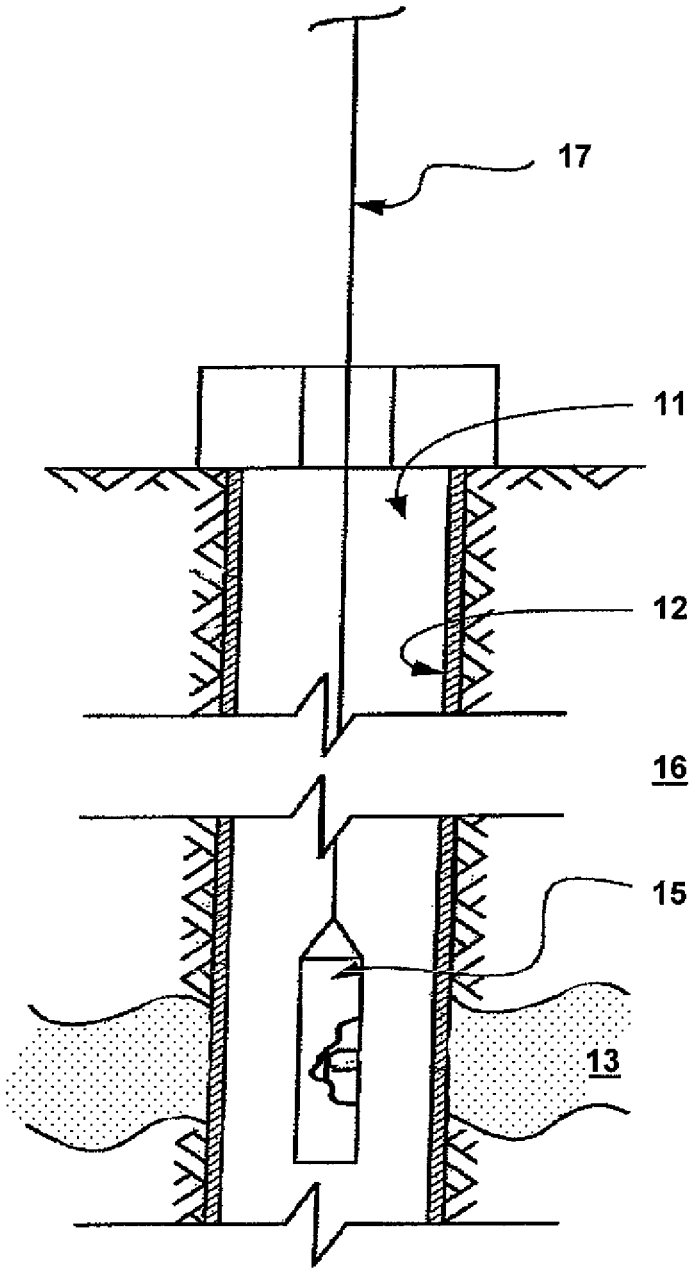
FIG. 1 (Prior Art)
FIG. 1 shows a conventional perforation operation, illustrating a perforation gun disposed in a well.
Figure 2:
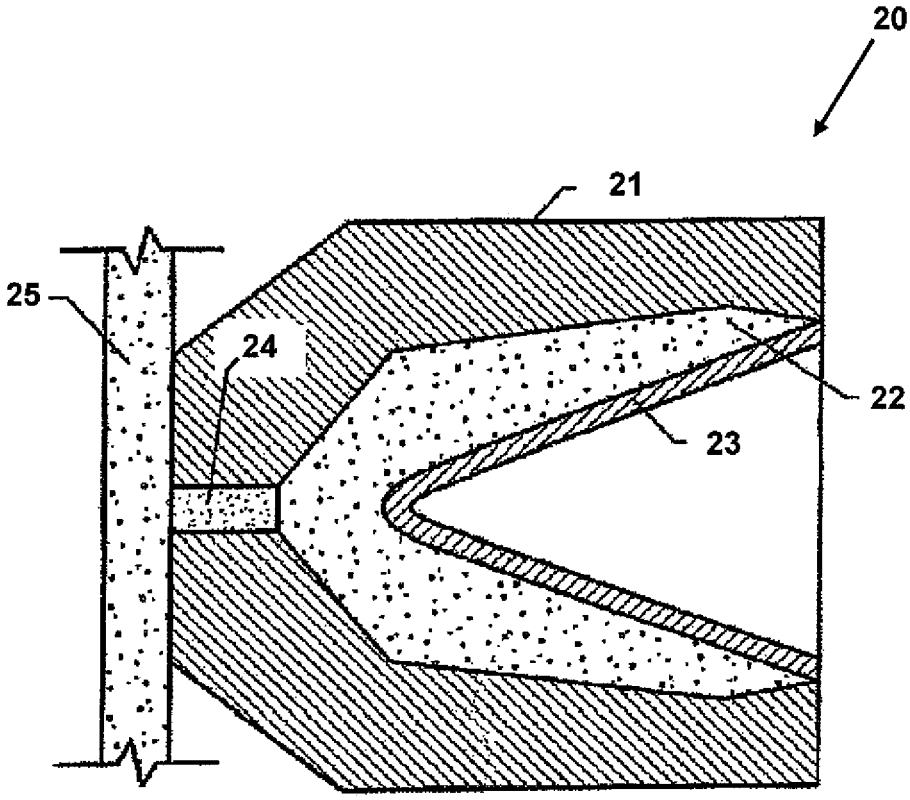
FIG. 2 shows a shaped charge for use in a perforation operation in accordance with one embodiment of the invention.

Referring to FIG. 2, a shaped charge 20 in accordance with embodiments of the present invention includes an outer case (a charge case) 21 that acts as a containment vessel designed to hold the detonation force of the detonating explosion long enough for a perforating jet to form. Materials for making the charge case may include steel or other sturdy metals. The main explosive charge (explosive) 22 is contained inside the charge case 21 and is arranged between the inner wall of the charge case and a liner 23. A primer column 24 (or other ballistic transfer element) is a sensitive area that provides the detonating link between the main explosive charge 22 and a detonating cord 25, which is attached to an end of the shaped charge. Examples of explosives 22 that may be used in the various explosive components (e.g., charges, detonating cord, and boosters) include RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene), HNS (hexanitrostilbene), and others.

To detonate a shaped charge, a detonation wave traveling through the detonating cord 25 initiates the primer column 24 when the detonation wave passes by, which in turn initiates detonation of the main explosive charge 22 to create a detonation wave that sweeps through the shaped charge. The liner 23 collapses under the detonation force of the main explosive charge.

Figure 3:
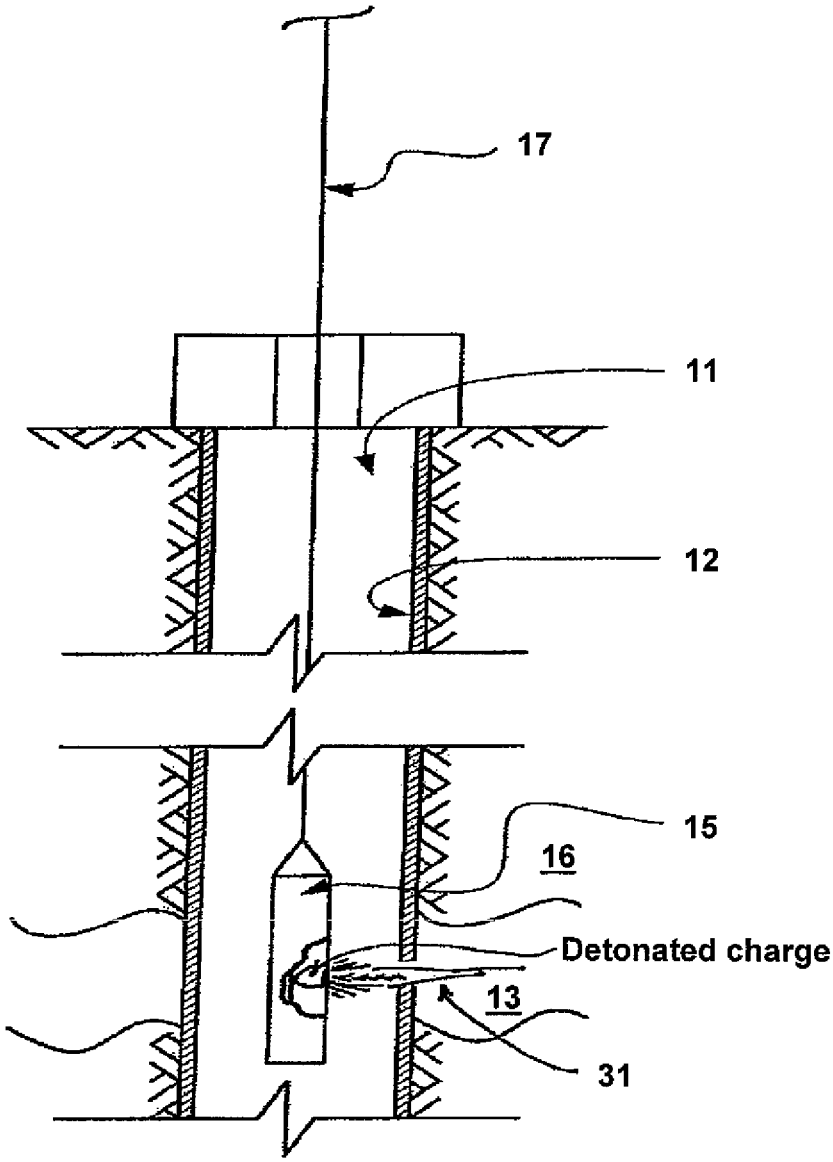
FIG. 3 shows a diagram illustrating a perforation being made with a perforation gun in accordance with one embodiment of the invention.
Figure 4:
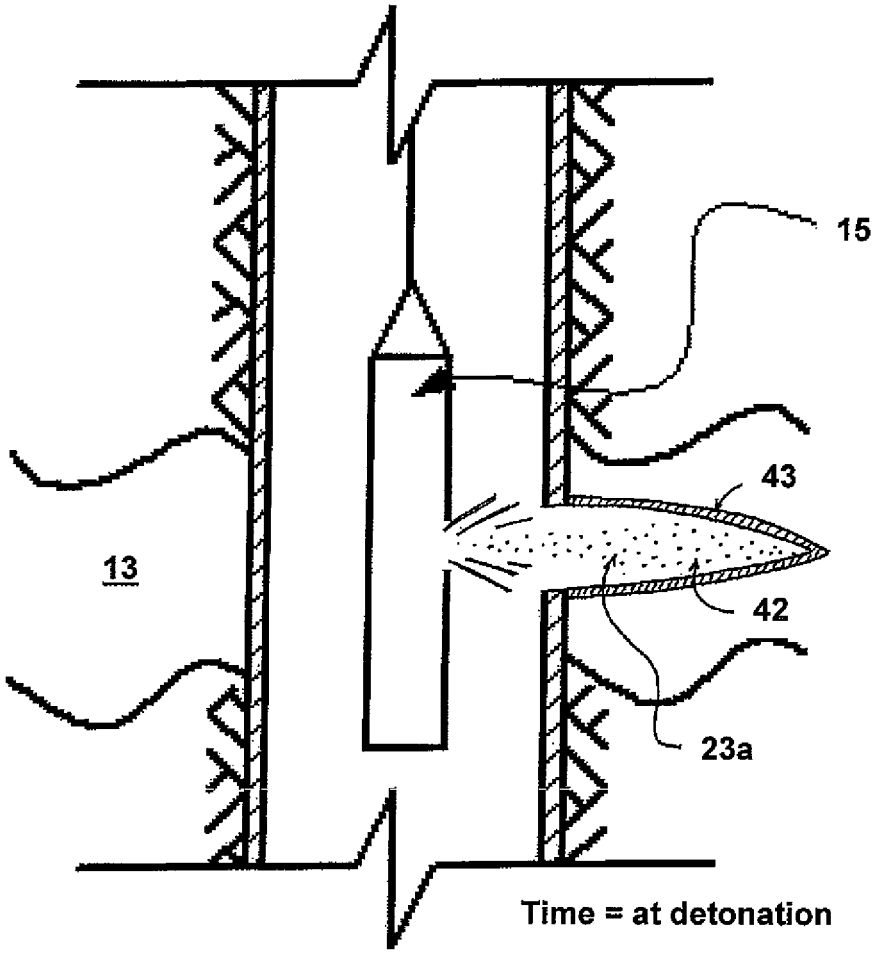
FIG. 4 shows a diagram illustrating a perforation and a tunnel made with a shaped charge in accordance with one embodiment of the invention.

Referring to FIG. 3, the material from the collapsed liner 23 forms a perforating jet 31 that shoots through the front of the shaped charge and penetrates the casing 12 and underlying formation 16 to form a perforated tunnel (or perforation tunnel) 42 (see FIG. 4). Referring to FIG. 4, around the surface region adjacent to the perforated tunnel 42, a layer of the formation (e.g., carbonate rock) is usually damaged or crushed by the shock wave. This damaged layer 43 may have a reduced permeability such that subsequent productivity of hydrocarbons is reduced.

In accordance with embodiments of the present invention, the shaped charge (capsule charge, or other explosive charge) includes a liner fabricated from a material 23*a* (e.g., a metal) that can chemically reacts with materials in the target well zone in the formation. As a result of this reaction, the damaged layer (or a substantial portion thereof) may be burnt away or otherwise decomposed. The exact mechanisms, by which the damaged layer is decomposed, depend on the compositions of the formation zone and the material used to fabricate the liner.

Figure 5:
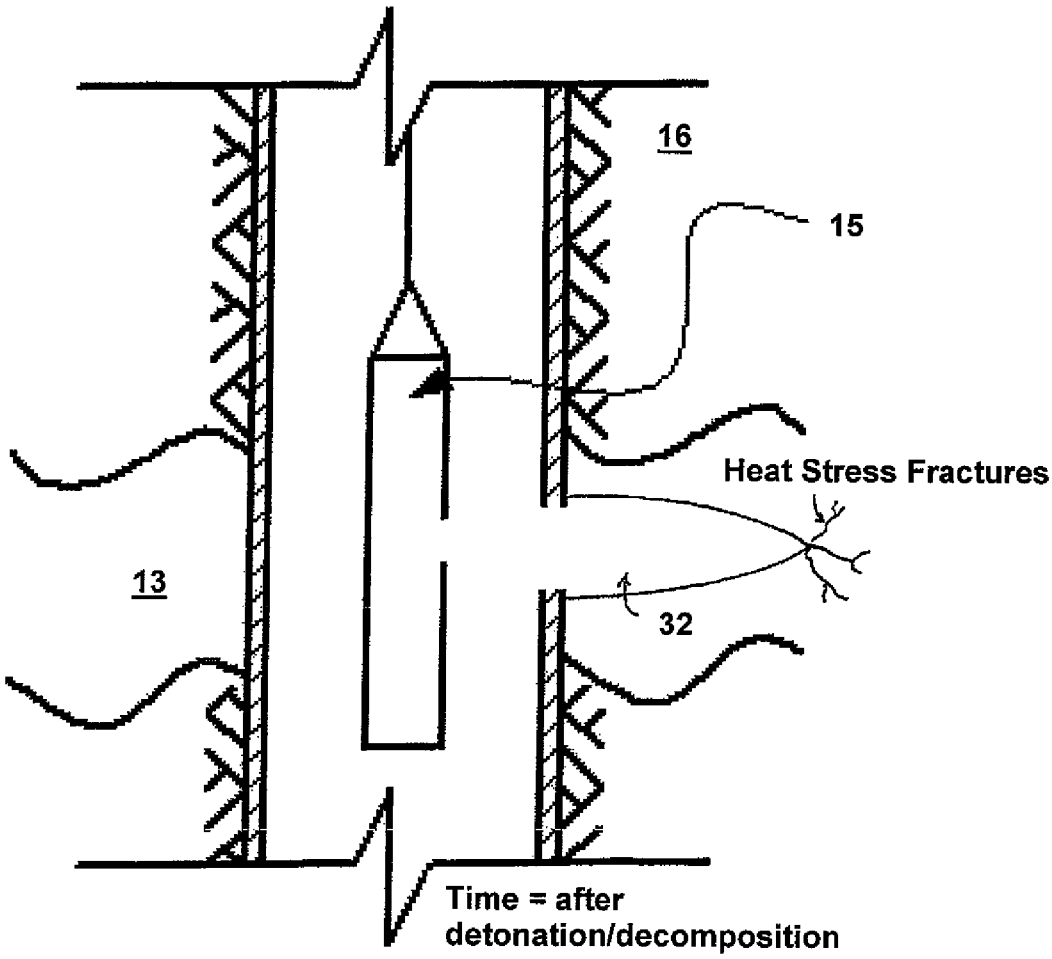
FIG. 5 shows a diagram illustrating the removal of the damaged layer and generation of additional fracture in the perforation tunnel in accordance with one embodiment of the invention.

For example, if the formation is a carbonate formation, then the damaged layer may be decomposed under thermal heating at relatively low temperatures. By using a liner formulation that reacts with the carbonate formation to generate heat within the perforated tunnel, the damaged layer may be removed. As a result, the perforated tunnel may be cleaned such that permeability of the target well zone can be increased at the tunnel surface region. Moreover, in some embodiments, the thermal stress created by the exothermic reaction between the liner material and the carbonate formation may also induce additional fractures in the formation radiating from the perforated tunnel 32, as illustrated in FIG. 5. These fractures may further increase permeability of the formation and subsequent productivity of the target well zone.

One of ordinary skill in the art would appreciate that the materials for use in the liner in accordance with embodiments of the invention may depend on the compositions of the formation zone of interest, such as carbonate formation or coal (carbon) formation. For example, for carbonate formations, explosive charges may have liners comprising one or more of the following metals (e.g., metal powders) (or a combination thereof):

titanium powder;

titanium alloy powder (e.g., titanium iron, titanium silicon, titanium nickel, titanium aluminum, titanium copper, and so forth);

titanium powder mixed with other metal powder (e.g., magnesium, tungsten, copper, lead, tin, zinc, gold, silver, steel, tantalum, and so forth);

titanium alloy powder mixed with other metal powder (e.g., magnesium, tungsten, copper, lead, tin, zinc, gold, silver, steel, tantalum, and so forth);

other metal powders that react with a carbonate formation (e.g., boron, lithium, aluminum, silicon, and magnesium); and other metal alloy powders that react with a carbonate formation (e.g., boron alloy, lithium alloy, aluminum alloy, silicon alloy, and magnesium alloy).

The particular metal or metal alloy or metal combination powder formulation may be selected depending on various well parameters. For example, the density of the metal powder is a factor that determines the penetration depth of the perforated tunnel. Thus, for a deeper penetration, it may be necessary to use a denser metal powder for the liner, such as titanium instead of aluminum. As another example, the reactivity of the metal powder is a factor that determines the liner formulation. By choosing a metal powder that is too reactive, the reaction may take place before the charge is detonated or before the liner can penetrate the casing and/or the formation zone. On the other hand, with a metal powder that is not sufficiently reactive, the reaction between the liner and the formation components (e.g., carbonate or carbon) may never occur. In still another example, the amount of heat generated by the reaction is a factor to be considered in selecting which metal (and the proportion) to include in the liner formulation. Titanium yields a relatively large amount of energy as it reacts with the carbonate formation, while aluminum yields a smaller amount of energy.

In accordance with some embodiments of the present invention, a liner of an explosive charge (i.e., a shaped charge) may comprise a reducing agent (e.g., iron, manganese, molybdenum, sulfur, selenium, zirconium, and so forth) and/or an oxidizing agent (e.g., PbO, $Pb_3O_4$, $KClO_4$, $KClO_3$, $Bi_2O_3$, $K_2Cr_2O_7$, and so forth) that can react with the metal. Upon detonation of the charge, the liner collapses and the reducing agent and/or oxidizing agent collide at a high velocity causing the liner components to react in the perforated tunnel, thus generating heat to decompose the damaged layer.

In accordance with some embodiments of the invention, the materials selected to fabricate the liner may not have sufficiently high densities to penetrate the casing and/or underlying formation, yet they may yield high exothermic heat energy when they react. In this case, the reactant materials may be combined with a denser component (e.g., tungsten, copper, lead, or others, or a combination thereof) to enhance penetration depth.

In accordance with some embodiments of the invention, a liner may be fabricated from a titanium or titanium alloy powder. For example, the titanium component of the liner may react with a carbonate (e.g., calcium or magnesium carbonate) formation to generate a relatively high amount of heat in accordance with the following reactions:

$CaCO_3+2Ti \rightarrow CaO+TiC+TiO_2$ (approx. 5.8 KJ of heat per gram of Ti);

and/or $MgCO_3+2Ti \rightarrow MgO+TiC+TiO_2$ (approx. 6.62 KJ of heat per gram of Ti).

Therefore, once titanium is introduced in the perforated tunnel, it will react with the carbonate and release a relatively large amount of heat. The reaction may remove part or all of the damaged zone. After the titanium is consumed, the heat released from the reaction may continue to decompose the surrounding carbonate. When carbonate is heated, $CO_2$ gas is released and the rock become porous.

In addition to carbonates, titanium can also react with various other components. In porous formation rocks, there are other compounds (e.g., water and/or oil), with which titanium can also react to release heat. For example, water and hydrocarbons (e.g., methane) can react with titanium according to the following reactions:

$H_2O+2Ti \rightarrow TiO+TiH_2$ (approx. 3.95 KJ per gram of titanium);

$CH_4+3Ti \rightarrow TiC+2TiH_2$ (approx. 2.77 KJ per gram of titanium, where $CH_4$ is an example of a hydrocarbon).

These reactions are exothermic and can generate a lot of heat. The heat not only will increase the reactants' temperature and accelerate the reaction rates, but may also cause the formation to decompose. The reaction and heat generated facilitate cleaning of the perforated tunnel and thus increase productivity. Moreover, in some cases, the damaged zone may be totally reacted and decomposed such that even some of the virgin rock is reacted due to the large amount of heat released by these reactions. When this occurs, the effects are two fold: (1) the damaged zone is cleaned up, and (2) the perforation tunnel is enlarged in diameter, which in turn can significantly reduce pressure drop for viscous flows and thus enhance productivity.

Elements like boron, lithium, aluminum, and manganese all have very good reactivity with carbonate (in addition to other compounds or elements). When these elements react with $CaCO_3$, they release approx. 14.1 KJ/gm, 9.78 KJ/gm, 8.57 KJ/gm and 5.75 KJ/gm of heat, respectively. These elements are thus also good candidates for reactive liner materials in carbonate formation application.

Uranium, while not necessarily as reactive as other light metals mentioned above (releasing only approx. 2.15 KJ/gm with $CaCO_3$), has a relatively high density (approx. 18.97 g m/cc) and can thus produce deeper penetration and deliver a higher shock pressure, which may also assist carbonate decomposition.

In accordance with embodiments of the invention, the liners of shaped charges may be made of only the selected materials. Alternatively, the selected materials may be mixed with other metal (e.g., copper) to make a liner. In these embodiments, the selected materials and the other metal (if present) may form a homogeneous phase; there is no need to sequester the "reactive" materials because such "reactive" materials are selected to be reactive with components in the formation. Therefore, such "reactive" materials can co-exist with other materials used to make the liners.

While the above description focuses on reactions between the liner material and the carbonate in the formation. Other reactions involving other components (e.g., carbon, silica, aluminum, water, hydrocarbons, etc.) in the formation may also produce similar effects. Examples of other reactions, which may release relatively large amounts of heat, include the following:

$Ti+C \rightarrow TiC$ (approx. 3.12 KJ/gm);

$3Fe_3O_4+8Al \rightarrow 4Al_2O_3+9Fe$ (approx. 3.68 Kj/gm);

$2Fe_2O_3+3Si \rightarrow 3SiO_2+4Fe$ (approx. 2.68 KJ/gm);

$Fe_2O_3+2Al \rightarrow Al_2O_3+2Fe$ (approx. 3.99 KJ/gm);

$2CuO+Si \rightarrow SiO_2+2Cu$ (approx. 3.18 KJ/gm); and $3CuO+2Al \rightarrow Al_2O_3+3Cu$ (approx. 4.11 KJ/gm).

Other oxides like CoO, $Co_3O_4$, NiO, $Ni_2O_3$, and $PbO_2$ can also react with Si and Al to release heat ranging from 2.05 KJ/gm to 5.41 KJ/gm. Therefore, these compounds are also good candidates for making the liners in accordance with embodiments of the invention.

While certain embodiments of the present invention are described with respect to perforating a cased wellbore, it is intended that other embodiments may be used for enhanced perforation of open hole or "uncased" wells. Moreover, while some embodiments of the perforating charge described above include an enhanced shaped charge, it is intended that other embodiments include an enhanced capsule charge or any charge for use in perforating a wellbore formation.

Liners in accordance with embodiments of the invention may be prepared with any method known in the art, including: 1) casting processes; 2) forming processes, such as powder metallurgy techniques, hot working techniques, and cold working techniques; 3) machining processes; and 4) other techniques, such as grinding and metallizing.

Figure 6:
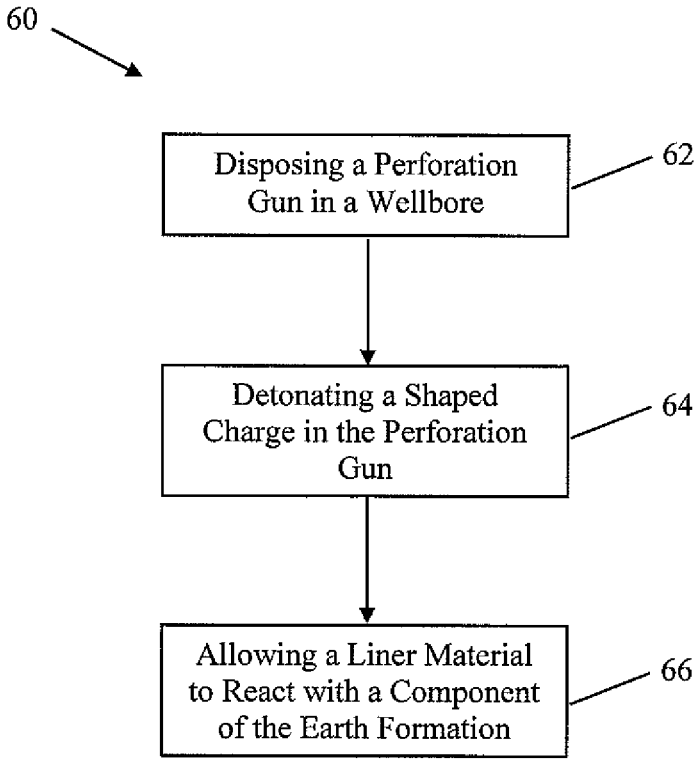
FIG. 6 shows a method for perforating a well in accordance with one embodiment of the invention.

Some embodiments of the invention relate to methods for perforation in a well, cased or uncased. As shown in FIG. 6, a method 60 in accordance with one embodiment of the invention includes the steps of: lowering a perforation gun into a wellbore (step 62). The perforation gun has one or more shaped charges that have liners made of a material capable of reacting with one or more formation compositions, as described above. Then, the perforation gun is fired to create one or more perforations and perforation tunnels (step 64). Afterwards, the liner material(s) is allowed to react with the formation compositions in order to degrade the damaged layer of the perforation tunnels (step 66). This leads to perforation tunnels that have improved permeability.

Note that while the above description uses carbonate formations to illustrate the reactions that can be used to improve productions, one of ordinary skill in the art would appreciate that embodiments of the invention is not limited to carbonate formations. As noted above, various reactive materials (e.g., titanium, aluminum, and other metals) that can react with other components in the formations may also be used. Therefore, embodiments of the invention can be applied to all types of formation, including carbonate formations, coal formations, sandstone formations, for example.

Advantages of embodiments of the invention may include one or more of the following. A shaped charge of the invention has a liner that will not damage the perforation tunnel. In addition, the materials that form the liner may be selected to react with one or more components of the formation to degrade any damaged layer that might form during the perforation operations. Shaped charges of the invention may be manufactured with existing equipment and may be deployed with existing techniques.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A shaped charge, comprising:

a charge case;

an explosive disposed inside the charge case; and a liner for retaining the explosive in the charge case, wherein the liner consisting essentially of a liner material that can chemically react with a component of an earth formation, wherein the liner material is selected from the group consisting of boron, boron alloy, lithium, lithium alloy, silicon, silicon alloy, magnesium alloy, manganese, $Fe_3O_4$, $Fe_2O_3$, CuO, CoO, $Co_3O_4$, NiO, $Ni_2O_3$, and $PbO_2$.

2. The shaped charge of claim 1, wherein the liner material is selected from boron, boron alloy, lithium, lithium alloy, silicon, silicon alloy, and magnesium alloy.

3. The shaped charge of claim 1, wherein the component of the earth formation is one selected from calcium carbonate, magnesium carbonate, carbonate, carbon, water, and a hydrocarbon.

4. The shaped charge of claim 3, wherein the liner material is selected from boron, lithium, and manganese.

5. The shaped charge of claim 1, wherein the liner material is selected from $Fe_3O_4$, $Fe_2O_3$, CuO, CoO, $Co_3O_4$, NiO, $Ni_2O_3$, and $PbO_2$.

6. A shaped charge, comprising:

a charge case;

an explosive disposed inside the charge case; and a liner for retaining the explosive in the charge case, wherein the liner consisting essentially of a liner material and a dense component, wherein the liner material can chemically react with a component of an earth formation, wherein the liner material is selected from the group consisting of boron, boron alloy, lithium, lithium alloy, silicon, silicon alloy, magnesium alloy, manganese, $Fe_3O_4$, $Fe_2O_3$, CuO, CoO, $Co_3O_4$, NiO, $Ni_2O_3$, and $PbO_2$.

7. The shaped charge of claim 6, wherein the dense component is at least one selected from tungsten, copper, and lead.

8. A method for perforating in a well, comprising:

disposing a perforating gun in the well, wherein the perforating gun comprises a shaped charge comprising:

a charge case;

an explosive disposed inside the charge case; and a liner for retaining the explosive in the charge case, wherein the liner consists essentially of a liner material that can chemically react with a component of an earth formation, wherein the liner material is selected from the group consisting of boron, boron alloy, lithium, lithium alloy, silicon, silicon alloy, magnesium alloy, manganese, $Fe_3O_4$, $Fe_2O_3$, CuO, CoO, $Co_3O_4$, NiO, $Ni_2O_3$, and $PbO_2$;

detonating the shaped charge to form a perforation tunnel in a formation zone; and allowing the liner material to react with the component of the earth formation.

9. The method of claim 8, wherein the liner material is selected from boron, boron alloy, lithium, lithium alloy, silicon, silicon alloy, and magnesium alloy.

10. The method of claim 8, wherein the component of the earth formation is one selected from carbonate, carbon, water, and a hydrocarbon.

11. The method of claim 8, wherein the component of the earth formation is at least one selected from calcium carbonate and magnesium carbonate.

12. The method of claim 11, wherein the liner material is selected from boron, lithium, and manganese.

13. The method of claim 8, wherein the liner material is selected from $Fe_3O_4$, $Fe_2O_3$, CuO, CoO, $Co_3O_4$, NiO, $Ni_2O_3$, and $PbO_2$.

14. A method for perforating in a well, comprising:

disposing a perforating gun in the well, wherein the perforating gun comprises a shaped charge comprising:

a charge case;

an explosive disposed inside the charge case; and a liner for retaining the explosive in the charge case, wherein the liner consists essentially of a liner material and a dense component, wherein the liner material can chemically react with a component of an earth formation, wherein the liner material is selected from the group consisting of boron, boron alloy, lithium, lithium alloy, silicon, silicon alloy, magnesium alloy, manganese, $Fe_3O_4$, $Fe_2O_3$, CuO, CoO, $Co_3O_4$, NiO, $Ni_2O_3$, and $PbO_2$;

detonating the shaped charge to form a perforation tunnel in a formation zone; and allowing the liner material to react with the component of the earth formation.

15. The method of claim 14, wherein the dense component is at least one selected from tungsten, copper, and lead.

* * * * *